US007098162B2

(12) United States Patent
Le Van Mao

(10) Patent No.: US 7,098,162 B2
(45) Date of Patent: Aug. 29, 2006

(54) CATALYSTS FOR DEEP CATALYTIC CRACKING OF PETROLEUM NAPHTHAS AND OTHER HYDROCARBON FEEDSTOCKS FOR THE SELECTIVE PRODUCTION OF LIGHT OLEFINS AND METHOD OF MAKING THEREOF

(75) Inventor: Raymond Le Van Mao, Saint-Laurent (CA)

(73) Assignee: Valorbec Societe en Commandite, Montreal (CA)

( * ) Notice: Subject to any disclaimer, the term of this patent is extended or adjusted under 35 U.S.C. 154(b) by 117 days.

(21) Appl. No.: 10/203,230

(22) PCT Filed: Jul. 27, 2001

(86) PCT No.: PCT/CA01/01107

§ 371 (c)(1),
(2), (4) Date: May 7, 2003

(87) PCT Pub. No.: WO02/10313

PCT Pub. Date: Feb. 7, 2002

(65) Prior Publication Data

US 2003/0181323 A1 Sep. 25, 2003

Related U.S. Application Data

(60) Provisional application No. 60/221,903, filed on Jul. 31, 2000.

(51) Int. Cl.

| | |
|---|---|
| ***B01J 23/26*** | (2006.01) |
| ***B01J 37/02*** | (2006.01) |
| *C10G 11/04* | (2006.01) |
| *C10G 11/05* | (2006.01) |

(52) U.S. Cl. ..... 502/69; 502/71; 502/256; 502/263; 502/527.24

(58) Field of Classification Search ..... 502/63, 502/64, 68, 69, 71, 73, 77, 84, 256, 263, 502/319, 320, 527.24
See application file for complete search history.

(56) References Cited

U.S. PATENT DOCUMENTS

| | | | | | |
|---|---|---|---|---|---|
| 2,849,383 | A | * | 8/1958 | Hirschler et al. | 208/119 |
| 2,887,450 | A | * | 5/1959 | Hirschler et al. | 208/120.3 |
| 3,013,988 | A | * | 12/1961 | Bukata et al. | 502/79 |
| 3,557,234 | A | * | 1/1971 | Henry et al. | 585/319 |
| 4,732,881 | A | * | 3/1988 | Le Van Mao | 502/71 |
| 4,829,040 | A | * | 5/1989 | Ward | 502/206 |
| 4,966,969 | A | * | 10/1990 | Sato et al. | 544/352 |
| 5,135,898 | A | * | 8/1992 | Le Van Mao et al. | 502/61 |
| 6,090,272 | A | * | 7/2000 | Drake et al. | 208/138 |

FOREIGN PATENT DOCUMENTS

| | | | |
|---|---|---|---|
| EP | 0 26 2 049 | * | 3/1988 |
| GB | 553736 | | 6/1943 |
| GB | 1332468 | | 10/1973 |
| JP | 50 004002 | | 1/1975 |
| JP | 57-159726 | * | 10/1982 |

OTHER PUBLICATIONS

Le Van Mao et al., "Hybrid catalysts containing zeolite ZSM-5 and supported gallium oxide in the aromatization of n-butane", Catalysis Today, vol. 31, 1996, pp. 247-255.*
Le Van Mao, "Hybrid catalyst containing a microporous zeolite and a mesoporous cocatalyst forming a pore continuum for a better desorption of reaction products", Microporous and Mesoporous Materials, vol. 28, 1999, pp. 9-17.*
Le Van Mao et al., "Selective deep catalytic cracking process (SDCC) of petroleum feedstocks for the production of light olefins", Catalysis Letters, vol. 73, No. 2-4, May 2001, pp. 181-186.*
Full English translation of JP 57-159726, published Oct. 1, 1982.*
Petrochemical Processes, Chauvel, A. et al., 1989, Edition Technip, vol. 1, p. 130.
Petrochemical Processes, Chauvel, A. et al., 1989, Edition Technip, vol. 1, p. 188.
U.S. Appl. No. 60/163,459, Le Van Mao, R.—"Selective deep catalytic cracking of petroleum napthas and other hydrocarbon feedstocks for the production of light olefins and aromatics", Filed Nov. 4, 1999.

* cited by examiner

*Primary Examiner*—Stanley S. Silverman
*Assistant Examiner*—Ardith E. Hertzog
(74) *Attorney, Agent, or Firm*—Ryan Kromholz & Manion, S.C.

(57) ABSTRACT

Provided herein are monocomponent and hybrid catalyst compositions for use in steam-cracking of hydrocarbon feeds to selectively produce light olefins. The catalyst compositions being characterized by a first catalytic component comprising oxides of aluminum, silicon, chromium, and optionally, oxides of monovalent alkaline metals, and further comprising a binder, preferably bentonite clay. Preferably, the catalyst compositions will comprise a catalytic component in accordance with the following formula: (a) $SiO_2$·(b) $Al_2O_3$·(c) $Cr_2O_3$(d) $alk_2O$, with alk being a monovalent alkaline metal, preferably selected from sodium, potassium and lithium. The second catalytic component is selected from a crystalline zeolite or a silica molecular sieve. Also provided in the present invention are methods of making the catalyst compositions.

11 Claims, No Drawings

CATALYSTS FOR DEEP CATALYTIC CRACKING OF PETROLEUM NAPHTHAS AND OTHER HYDROCARBON FEEDSTOCKS FOR THE SELECTIVE PRODUCTION OF LIGHT OLEFINS AND METHOD OF MAKING THEREOF

RELATED APPLICATION

This Application is a 371 of PCT/CA01/01107, filed 27 Jul. 2001, which claims the benefit of U.S. Provisional Patent Appln. No. 60/221,903. filed 31 Jul. 2000.

BACKGROUND OF THE INVENTION

1. Field of Invention

The present invention relates to the catalysts used in the deep catalytic cracking (DCC) of petroleum naphthas and other hydrocarbon feedstocks. More specifically, the invention provides catalysts containing silicon, aluminum, chromium, and optionally, monovalent alkaline metal oxides. Such catalyst compositions are capable of selectively converting petroleum naphthas and other hydrocarbon feedstocks into commercial valuable light olefins, mainly ethylene and propylene.

2. The Prior Art

It is known to use the technique of steam-cracking on light paraffins (ethane, propane and butane, obtained mainly by extraction from various natural gas sources) and on naphthas and other heavier petroleum cuts, to produce:

i) primarily ethylene and propylene;

ii) secondarily, depending on the feedstock employed, a $C_4$ cut rich in butadienes and a $C_5^+$ cut with a high content of aromatics, particularly benzene;

iii) and finally hydrogen.

The feedstocks of choice are ethane and liquid petroleum gas (LPG) for the U.S.A. and naphthas and gas oils for Europe. However, in recent years, the situation has dramatically changed with the U.S.A. moving towards the utilization of heavier hydrocarbon feedstocks like in Europe.

It is worth noting that steam cracking is one of the core processes in the petrochemical industry with a worldwide production of ca. 100 million metric tons/year of ethylene and propylene.

Steam cracking is a thermal cracking reaction performed at high temperatures and in the presence of steam, a diluant which is concurrently fed with the hydrocarbon stream in a steam cracking reactor. The reaction temperature ranges from 700° C. to 900° C. according to the type of feedstock treated (the longer the hydrocarbon molecular structure, the lower the temperature of cracking), while the residence time ranges from a few seconds to a fraction of second.

Steam cracking is a well-established technology. However, it suffers from many drawbacks:

i) lack of flexibility in the product selectivity, mostly in the yield of propylene which needs to be increased in order to respond to the increasing demand of the market.

ii) significant production of fuel oil which contains heavy hydrocarbons such as heavy alkylaromatics and even polyalkylaromatics. It is known that the latter products are precursors of "coke". Coking is a serious problem in the steam cracking technology, which decreases the energy efficiency and requires difficult de-coking procedures for reactors.

iii) in order to achieve a satisfactory conversion, severe operating conditions are used; i.e. high reaction temperatures and the recycling of gaseous paraffinic products.

More than twelve years ago, a process aiming at upgrading the products of propane steam cracking was developed in the laboratory of the present inventor [1]. The upgrading consisted of adding a small catalytic reactor to a conventional propane steam cracker. The catalysts used in the catalytic reactor were based on the ZSM-5 zeolite modified with Al and Cr [2]. Significant increases in the yield of ethylene and aromatics were obtained.

More recently, the present inventor's research group developed a further refined process [3,4] consisting of using two reactors in sequence, the first reactor (I) containing a mildly active but robust catalyst and the second reactor (II) being loaded with a ZSM5 zeolite based catalyst, preferably of the hybrid configuration. Hybrid configuration means that at least two co-catalysts are commingled. Variations of the temperature of reactor I versus reactor II and the textural properties and/or the surface composition of the catalyst of reactor (I) were used to increase the conversion and to vary the product distribution, namely the ethylene/propylene ratio.

Although our previous work is of great industrial interest, the use of two reactors, which require heating at different temperatures, represents a significant challenge in terms of technology and investment.

Thus, the present invention responds to the need for a simplified technology while maintaining catalyst performance and product flexibility at significantly higher levels than what is currently achieved with conventional steam cracking processes. The present invention focuses primarily on catalyst formulations.

Thus, it is an object of the present invention to provide novel catalysts for selective deep catalytic cracking (DCC) of petroleum naphthas and other hydrocarbon feedstocks.

SUMMARY OF THE INVENTION

In general terms, the present invention provides monocomponent and hybrid catalyst compositions for use in steam-cracking of hydrocarbon feeds to selectively produce light olefins, said catalyst compositions comprising oxides of aluminum, silicon, chromium, and optionally, oxides of monovalent alkaline metals, said catalyst compositions further comprising a binder.

The catalyst compositions of the present invention will preferably comprise a catalytic component in accordance with the following formula:

(a)$SiO_2$.(b)$Al_2O_3$.(c)$Cr_2O_3$.(d)$alk_2O$, with alk being a monovalent alkaline metal.

Most preferably, the catalytic component will comprise said oxides are present in the following proportions:

(a) $SiO_2$:50–95 wt %;

(b) $Al_2O_3$:3–30 wt %;

(c) $Cr_2O_3$:2–10 wt %; and (d) $alk_2O$:0–18 wt %.

Most preferably, the alkaline metal will be selected from sodium, potassium and lithium. The binder will preferably be bentonite clay. Preferably, bentonite clay is present in a proportion ranging from 10 wt % to 30 wt % based on the total weight of the catalyst composition.

In hybrid configuration, the first catalytic component will be as described immediately above. The second catalytic component will be selected from a crystalline zeolite or a silica molecular sieve. Preferably, the weight ratio of the second catalytic component to the first catalytic component is 0.2 to 5.0.

The present invention also provides methods of making the catalyst compositions of the present invention.

Other objects and further scope of applicability of the present invention will become apparent from the detailed description given hereinafter. It should be understood, however, that the following detailed description, while indicating preferred embodiments of the invention, is given by way of illustration only, since various changes and modifications within the spirit and scope of the invention will become apparent to those skilled in the art.

DETAILED DESCRIPTION OF THE PREFERRED EMBODIMENT

This invention provides new catalysts for deep catalytic cracking (DCC) of petroleum naphthas and other hydrocarbon feedstocks for the selective production of light olefins, namely ethylene, propylene and butenes, particularly isobutene. BTX aromatics, mainly benzene, are also produced in significant amounts.

The catalysts of the present invention have the following chemical composition in terms of oxides:

(a)$SiO_2$.(b)$Al_2O_3$.(c)$Cr_2O_3$.(d)$alk_2O$, with alk being a monovalent alkaline metal.

The values of (a), (b), (c) and (d) are respectively in the following ranges:

(a) 50–95 wt %;

(b) 3–30 wt %;

(c) 2–10 wt %; and (d) 0–18 wt %.

Examples of monovalent alkaline metals are lithium, sodium and potassium.

It is worth mentioning that the catalyst formulations of the present invention contain chromium. However, they are chemically and catalytically different from the classical catalytic system used in the dehydrogenation of paraffins (example: dehydrogenation of propane to propylene [5]). The latter catalysts contain chromium oxide and alumina (20/80 percent weight) with some potassium or sodium oxide (a few %) used as dopant to decrease the cracking action of some acid sites. In contrast, the chromium containing catalysts of the present invention have a complex structure allowing a balance between the acidic properties (to induce a mild cracking activity) and the dehydrogenation properties of the catalyst. The synergy between these two catalytic functions is key to the highly selective characteristics of the catalysts of the present invention.

In the following, are described in detail:

the preparation procedure of reference catalysts and catalysts of the present invention;

the experimental set-up;

the testing procedure (in this series of tests, n-hexane (or eventually, n-octane) was used as model molecules for naphthas); and the catalytic results and discussion.

PREPARATION PROCEDURES

Monocomponent Catalysts

It is to be understood that the term "monocomponent" refers to a catalyst system using a single catalyst as opposed to the term "hybrid" which refers to a catalyst system using at least two commingled catalysts.

In order to compare the catalysts of the present invention to prior art efforts, reference catalysts were prepared.

Reference Catalyst, H-ZSM5(1) Zeolite Catalyst

This catalyst (Zeocat PZ-2/50, H-form, 1/16" extrudates) was purchased from Chemie Uetikon A G (Switzerland). It contains ca. 20 wt % of an unknown binder. Prior to catalytic testing, it was activated in air at 700° C. overnight. Its main physical properties are:

surface area=389 $m^2/g$;

microporosity=177 $m^2/g$; and

Si/Al=ca. 50.

This reference catalyst is herein referred to as H-ZSM5 (1).

Reference Catalyst, Cr/Alumina Catalyst (Cr/Al)

This catalyst reproduces the catalyst formulation currently used for the dehydrogenation of propane or other light alkanes. The catalyst was prepared as follows: 11 g of chromium nitrate ($Cr(NO_3)_3.9H_2O$, from Fisher) were dissolved in 30 ml of distilled water. Then 30 g of neutral alumina (Merk) were added to the solution under stirring for 15 minutes. The resulting slurry was evaporated to dryness on a hot plate. The solid obtained was dried at 120° C. overnight and activated in air at 500° C. for 3 hours. The resulting material had the following chemical composition:

$Cr_2O_3$=7.1 wt %; and $Al_2O_3$=92.9 wt %.

The reference catalyst, herein referred to as Cr/Al, was obtained by extrusion with bentonite clay as follows: first, the solid obtained was carefully mixed with bentonite (an hour stirring in dry conditions) which was used as binder (20 wt %). Water was then added dropwise until a malleable paste was obtained. The resulting catalyst extrudates were dried at 120° C. overnight and finally activated in air at 750° C. for 5 hours.

EXAMPLE 1

Monocomponent Catalysts of the Present Invention (CAT IIIa)

Preparation of a Mesoporous Silica Support (LuSi)

Such silica solid was obtained by evaporating to dryness the colloidal silica Ludox (trademark) AS-40 (Dupont) on a hot plate and subsequently heating in air at 120° C. overnight. It was then crushed to very fine particles (size: <80 mesh or <180 μm). This material is herein referred to as LuSi.

Preparation of the CAT IIIa

Two solutions were prepared:

Solution A: 30 g of chromium nitrate (Fisher) were dissolved in 50 ml of distilled water.

Solution B: 25 g of sodium aluminate (ACP Chemicals) were dissolved in 50 ml of distilled water.

Solutions A and B were mixed together under vigorous stirring for 10 minutes. Then 50 g of LuSi was added and the stirring was maintained for another 30 minutes. The slurry was evaporated to dryness using a Rotovap (trademark) and the obtained solid was dried at 120° C. overnight. The material was crushed to very fine particles (size <180 μm) before being activated in air at 500° C. for 3 hours.

The solid obtained had the following properties:

chemical composition:

$Cr_2O_3$=6.5 wt %; $Al_2O_3$=20.4 wt %; $SiO_2$=58.0 wt %; $Na_2O$=15.1 wt %;

surface area (BET)=50 $m^2/g$; and average pore diameter=15.0 nm.

The final catalyst extrudates were obtained by extrusion with bentonite (20 wt %), dried at 120° C. overnight, activated in air at 500° C. for 3 hours and finally at 750° C.

for another 5 hours. This catalyst is herein referred to as CAT IIIa.

Hybrid Catalysts

EXAMPLES 2 AND 3

Hybrid Catalysts of the Present Invention (CAT IIIb)

Preparation of the H-ZSM5(2) Zeolite

The H-ZSM5 zeolite used was the Zeocat PZ-2/50, H-form, powder, purchased from Chemie Uetikon A G (Switzerland). It was activated in air overnight at 550° C. Its main physical properties are:

surface area=483 $m^2/g$;

microporosity=277 $m^2/g$; and

Si/Al=ca. 50.

This material is referred to as H-ZSM5(2).

Preparation of the H-Silicalite

Seventy-five (75) g of silicalite (UOP, MHSZ-420, $SiO_2$=99.8 wt %, Si/Al>300) were immersed in 500 ml of a solution of ammonium chloride (10 wt %). The suspension, continuously stirred, was left at room temperature for 12 hours. It was then left to settle, filtrated and the solid obtained was immersed again in 500 ml of ammonium chloride solution. The new ion-exchange operation was carried for another 12 hours. Then, the solid was filtrated out, washed with distilled water, dried in air overnight at 120° C., finally activated at 500° C. for 3 hours. The resulting material is herein referred to as HSil.

The final catalyst extrudates were obtained by extrusion with bentonite (15 wt %), dried at 120° C. overnight, activated in air at 500° C. for 3 hours and finally at 750° C. for another 5 hours. This catalyst is herein referred to as HSil.

Preparation of the Chromium Based Cocatalyst

A solution of 34.0 g of chromium trioxide (Fisher Sc.) in 300 ml of distilled water was homogeneously impregnated onto 210 g of silica-alumina (SiAl from Aldrich, support grade 135, $SiO_2$=86 wt %; $Al_2O_3$=13 wt %; surface area=475 $m^2/g$). The solid, first left at room temperature for 30 minutes, was dried overnight at 120° C. and then activated at 500° C. for 3 hours.

The resulting solid had the following physico-chemical properties:

$SiO_2$=77 wt %; $Al_2O_3$=12 wt % and $Cr_2O_3$=11 wt %;

surface area=273 $m^2/g$;

microporosity=0 $m^2/g$; and median pore size=4.9 nm.

This material is referred to as Cocat.

Final Preparation of the Hybrid Catalysts (CAT IIIb)

EXAMPLE 2

The first example of hybrid catalyst was prepared by admixing 6 g of Cocat with 4 g of H-ZSM5(2) (powder). The solid mixture was then extruded with 1.5 g of bentonite clay (Spectrum Products). This catalyst, herein referred to as Cc(40)HZ, was first dried in air overnight at 120° C., then activated at 500° C. for 3 hours, and finally at 750° C. for 2 hours.

Doping with Li

The zeolite component was doped with Li in order to stabilize it. This was done because this hybrid catalyst had to be tested at high temperature and in the presence of steam (two conditions whose joint effects might be extremely detrimental to the zeolite structure). The hybrid catalyst was doped with Li as follows: log of Cc(40)HZ extrudates were homogeneously soaked (dropwise, using a pipet) with a solution of 0.72 g $LiNO_3$ in 8.5 ml of distilled water. The wet extrudates were left at room temperature for 30 minutes, then dried in air overnight at 120° C., then activated at 500° C. for 3 hours, and finally at 750° C. for 2 hours The final catalyst had a Li content of 1.5 wt % and is herein referred to as Cc(40)HZ/Li.

EXAMPLE 3

The second example of hybrid catalyst was prepared by admixing 3 g of Cocat with 7 g of HSil. The solid mixture was then extruded with 1.5 g of bentonite clay (Spectrum Products). The catalyst, herein referred to as Cc(70)HSil, was first dried in air overnight at 120° C., then activated at 500° C. for 3 hours, and finally at 750° C. for 2 hours.

Reference Catalysts

Once again, reference catalysts were made in order to compare the performance of the reference catalysts to those of the present invention. In this case, the reference catalysts were the individual components of the hybrid catalyst of the present invention namely, the H-ZSM5(2) zeolite catalyst and the cocatalyst, Cocat. Both individual components were doped with Li as was the case for the hybrid catalyst of the present invention.

Reference Catalyst, the H-ZSM5(2)/Li Zeolite Catalyst:

This reference zeolite catalyst was obtained by extrusion of the H-ZSM5(2) with bentonite clay. The resulting extrudates were first air dried overnight at 120° C., then activated at 500° C. for 3 hours, and finally at 750° C. for 2 hours. In order to stabilize the zeolite structure, the extrudates were treated with Li as described above in the section "Doping with Li". This catalyst is herein referred to as H-ZSM5(2)/Li.

Reference Catalyst: the Cc/Li

This reference catalyst was obtained by extrusion of the cocatalyst, Cocat, with bentonite clay. The resulting extrudates were first air dried overnight at 120° C., then activated at 500° C. for 3 hours, and finally at 750° C. for 2 hours. The extrudates were treated with Li as described above in the section "Doping with Li". This catalyst is herein referred to as Cc/Li.

Experimental Set Up

Experiments were performed within a Lindberg tubular furnace coupled to a Lindberg type 818 temperature control unit. The reactor vessel consisted of a quartz tube 95 cm in length and 2 cm in diameter. The catalyst temperature was measured by a thermocouple placed in a thermowell in quartz set exactly in the middle of the catalyst bed.

Testing Procedure

Liquids fed, namely n-hexane (or n-octane) and water, were injected into a vaporizer using a double-syringe infusion pump. The water/n-hexane or water/n-octane ratio was monitored using syringes of different diameters. In the vaporizer, nitrogen used as carrier gas, was mixed with n-hexane (or n-octane) vapors and steam. The gaseous stream was then sent to a tubular reactor containing the previously prepared catalyst extrudates. The products were analyzed by gas chromatography using a PONA capillary column for liquid phases and a GS-alumina capillary column for gaseous products.

The testing conditions were as follows:

Series CAT IIIa (feed=n-hexane)

Weight of catalyst=6.0 g (except for steam cracking runs in which no catalyst was used);

W.H.S.V. (weight hourly space velocity=g of reactant, i.e. n-hexane, injected per hour per g of catalyst)=0.2–0.3 $h^{-1}$;

Water/n-hexane weight ratio=0.36 or 0.71;

Nitrogen flow rate=11 or 7.5 ml/min; and

Duration of a run=5 h.

Series CAT IIIb (feed=n-hexane or n-octane)

Weight of catalyst=7.5 g (except for reference runs in which extrudates of catalytically inert bentonite clay were used);

W.H.S.V.=0.6 $h^{-1}$;

Water/n-paraffin weight ratio=0.71;

Reaction temperature=735° C.;

Nitrogen flow-rate=ca. 11.5 ml/min; and

Duration of a run=4 h.

Results and Discussion

Series CAT IIIa

Table 1 reports the performance of a non-catalysed steam cracking process (column #1) reference catalysts (columns #2 and #3), in comparison to the catalysts of the present invention (columns #4 to #7).

In column #1 are reported the data from a typical industrial process which operates without catalyst (non-catalytic steam cracking) at high severity (high reaction temperature, recycling of some product light paraffins such as ethane and propane) using a medium-range naphtha as feed [6]. It is seen that with such a feedstock (mixture of $C_{5-200}$° C. hydrocarbons), some heavy oil (fuel oil) and a large amount of methane are produced by the thermal cracking. The ethylene/propylene ratio is ca. 2.2.

TABLE 1

| Performance of the CAT IIIa, monocomponent catalysts of the present invention | | | | | | | |
|---|---|---|---|---|---|---|---|
| | Column | | | | | | |
| | 1 | 2 | 3 | 4 | 5 | 6 | 7 |
| | Process | | | | | | |
| | Steam cracking | | | Deep catalytic cracking | | | |
| | Feed | | | | | | |
| | medium-range naphtha | n-hexane as model molecule | | n-hexane | | | |
| | Catalysts | | | | | | |
| | no | H-ZSM5 (1) | CrAl | CAT IIIa | | | |
| | Process conditions | | | | | | |
| | indust. high severity with recycle T = 850° C. | T = 675° C. R = 0.36 a | T = 690° C. R = 0.36 b | T = 715° C. R = 0.36 a | T = 715° C. R = 0.71 a | T = 735° C. R = 0.71 a | T = 745° C. R = 0.71 a |
| Yields (wt %) | | | | | | | |
| ethylene | 33.6 | 21.1 | 16.6 | 27.8 | 26.2 | 30.9 | 35.0 |
| propylene | 15.6 | 23.5 | 16.1 | 22.2 | 23.7 | 21.8 | 17.2 |
| butadiene | 4.5 | 0.0 | 1.1 | 3.9 | 4.4 | 3.8 | 3.2 |
| butenes | 3.7 | 6.4 | 2.1 | 3.8 | 3.8 | 3.1 | 1.5 |
| aromatics | 11.9 | 14.1 | 28.4 | 9.3 | 7.0 | 8.5 | 12.6 |
| non-aromatics | 6.8 | 3.3 | 1.3 | 5.0 | 5.1 | 5.1 | 3.3 |
| fuel oil ($C_9^+$) | 4.7 | trace | >0.2 | 0.1 | 0.1 | 0.1 | 0.1 |
| methane | 17.2 | 6.2 | 9.6 | 8.3 | 7.1 | 9.9 | 12.4 |
| other light paraffins | 0.5 | 24.0 | 25.1 | 11.2 | 8.0 | 8.8 | 11.7 |
| ethylene + propylene | 49.2 | 44.6 | 37.7 | 50.0 | 49.9 | 52.7 | 52.2 |
| ethylene/propylene | 2.2 | 0.9 | 1.0 | 1.3 | 1.1 | 1.4 | 2.0 |
| light olefins and diolefins | 57.9 | 51.0 | 40.9 | 58.1 | 58.1 | 59.6 | 56.9 |
| Notes and remarks | (*) | instable | instable | | very stable | | |

R = $H_2O$/hydrocarbon feed ratio (by weight)

Weight hourly space velocity: a = 0.3–0.4 $h^{-1}$ and b = 0.2 $h^{-1}$ (*) At T = 850° C. and R = 0.71,the steam-cracking of n-hexane gave similar product yields. However, rapid coking of the reactor walls with a consequent rapid activity decay (steady increase of methane production) was observed.

The CAT IIIa showed a high on-stream stability (at least 6 hours of reaction).

It is to be understood that the use of n-hexane as a model molecule for naphthas, closely reproduces the reaction behavior of a naphtha feed. In particular, in the n-hexane steam cracking, as in the case of naphthas, the reactor walls are rapidly covered with carbonaceous species resulting in severe on-stream instability.

Column #2 reports the results of the catalytic performance of the reference catalyst H-ZSM5(1) zeolite used using the n-hexane feed as the model for naphthas. With respect to the steam cracking (column #1), this catalyst yields a higher amount of aromatics; however, the production of light olefins is in many cases much lower. There are no heavy hydrocarbons in the fuel oil range produced. However, the production of light paraffins is dramatically increased owing to well known hydride transfer phenomena during the dehydrocyclization (aromatization) step, which usually occur within the zeolite catalysts. As expected, the H-ZSM5(1) zeolite undergoes rapid activity decay because of its microporous structure being strongly affected by coke fouling at such high reaction temperature.

Column #3 reports the results of another reference catalyst, the CrAl. This catalyst behaves in a similar way as the H-ZSM5(1), however at such high temperatures, the production of aromatics is even much more important. This occurs mainly at the expenses of light olefins (mostly, ethylene and propylene). The CrAl is very instable due to a rapid coking at the high reaction temperature used. Doping the CrAl catalyst with alkaline metal ions (a few wt %) does not significantly improve the yields of ethylene and propylene.

In Columns #4 to #7 are reported the catalytic performance of the CAT IIIa of the present invention tested at various operating conditions. The advantages of the use of CAT IIIa in comparison with the non-catalytic steam cracking (column #1) and catalytic steam cracking with reference catalysts (column #2 to #3) are numerous and of significant importance:

In terms of catalyst performance:

The combined yield of ethylene and propylene is significantly higher: ca. 7 wt % increase when the catalytic reaction is carried out at 730–740° C. (column #6).

The ethylene/propylene ratio can be varied by varying the water/n-hexane ratio (R). In fact, the higher the R ratio, the lower the value of the product ethylene-to-propylene ratio, while the combined (ethylene+propylene) yield does not significantly change (columns #4 and #5). The variation of this ratio can also be achieved by varying the reaction temperature within the temperature range of 715–745° C. (columns #5 to #7).

Benzene is produced in most reaction conditions for ca. 70% of the total aromatics, the remaining being toluene and xylenes. By varying the temperature (columns #5 and #7), the contact time, or the steam dilution (columns #4 and #5), the total amount of aromatics produced can significantly change without inducing a significant variation of the combined (ethylene+propylene) yield.

No significant amount of heavy hydrocarbons in the fuel oil range is produced (columns #4 to #7 versus column #1).

The production of the commercially least valuable product, methane, is dramatically reduced (columns #4 to #7 versus column #1).

In the reaction conditions used for tests reported in columns # 4 to #7, CAT IIIa is on-stream very stable, i.e. for at least 6 hours (variations of the conversion and selectivity: all lower than 3%), except for a short induction period of less than 15 minutes corresponding presumably to the catalyst self-activation.

The CAT IIIa totally recovers its activity and selectivity after regeneration in air and even after dozens of catalytic (reaction/regeneration) cycles.

There is no apparent damage of the catalyst surface (i.e. no reduction of surface area) and also, no change of the chemical composition even after dozens of catalytic cycles.

In terms of technology required by the catalyst of the present invention:

Only catalyst bed in a reactor may be used, thus allowing for the use of a very simple tubular configuration.

The reaction temperature is much lower than that used for non-catalytic steam cracking, by more than 100° C. (columns #4 to #7 versus column #1).

The catalysts can be regenerated in-situ, in air at 500–550° C. for less than 4 hours, inferring that the coke formed on the catalysts is a "light" coke, in contrast with the "heavy" coke produced by the steam cracking. This can be associated with the absence of heavy oil in the product spectrum of CAT IIIa (columns #4 to #7), in contrast with the non-catalytic steam cracking (column #1) which produces a significant amount of such heavy hydrocarbon products. It is worth noting that the amount of coke deposited on CAT IIIa is by far less important than that of non-catalytic steam cracking, so that the amounts of carbon dioxide and other volatile oxides emitted during the catalyst regeneration phase (this invention) are much lower than that emitted during the decoking phase of the steam-cracking reactor and related quench boilers.

The on-stream stability (for at least 6 hours) and the relatively easy regeneration procedure (less than 4 hours) infer the possible use of the simplest reactor configuration: a dual system of tubular reactors (some in working conditions and the others in regeneration phase).

Series CAT IIIb

Table 2 reports the catalytic data of:

The bentonite extrudates which are assumed not to have any significant activity other than the thermal cracking (columns #1 and #2).

The reference catalysts, H-ZSM5(2)/Li and Cc/Li (columns #3 to #6).

The hybrid catalysts of this invention (Cat IIIb), namely Cc(40)HZ/Li and Cc(70)Hsil (columns # 7 to #9).

All runs were carried out in the conditions reported in the procedure section.

TABLE 2

Performance of the CAT IIIb, hybrid catalysts of the present invention

| | Column | | | | | | | | |
|---|---|---|---|---|---|---|---|---|---|
| | 1 | 2 | 3 | 4 | 5 | 6 | 7 | 8 | 9 |
| | Catalyst | | | | | | | | |
| | Bentonite | | H-ZSM5 (2)/Li | | Cc/Li | | Cc(40) HZ/Li | | Cc(70) HSil |
| | CAT IIIb | | | | | | | | |
| | Feed (*) | | | | | | | | |
| | n-hex | n-oct | n-hex | n-oct | n-hex | n-oct | n-hex | n-oct | n-hex |
| Product yields (wt %) | | | | | | | | | |
| ethylene | 28.26 | 34.47 | 22.93 | 29.51 | 26.88 | 28.05 | 28.69 | 32.10 | 25.34 |
| propylene | 20.48 | 20.76 | 20.30 | 20.30 | 19.58 | 16.50 | 25.27 | 26.96 | 26.87 |
| butadiene | 3.10 | 3.61 | 2.71 | 3.02 | 2.82 | 2.93 | 0.77 | 0.86 | 1.26 |
| n-butenes | 5.36 | 4.53 | 5.51 | 4.03 | 4.09 | 4.07 | 2.82 | 3.65 | 2.76 |
| isobutene | 0.16 | 0.23 | 1.98 | 2.61 | 1.74 | 1.91 | 2.16 | 2.70 | 2.21 |
| aromatics | 3.16 | 4.73 | 5.38 | 8.23 | 7.57 | 7.88 | 11.53 | 11.29 | 11.37 |
| non-aromatics ($C_5^+$) | 3.68 | 5.12 | 4.27 | 4.21 | 4.23 | 5.10 | 1.26 | 1.99 | 1.97 |
| fuel oil ($C_9^+$) | 0.00 | 0.00 | 0.07 | 0.68 | 0.00 | 0.77 | 0.49 | 0.00 | 0.03 |
| methane | 8.61 | 7.22 | 5.10 | 7.49 | 10.30 | 8.80 | 7.81 | 8.39 | 7.94 |
| other light paraffins | 5.13 | 6.27 | 5.68 | 6.83 | 7.80 | 7.80 | 10.96 | 10.05 | 12.38 |
| ethylene + propylene | 48.74 | 55.23 | 43.23 | 49.81 | 46.46 | 44.55 | 53.96 | 59.06 | 52.21 |
| ethylene/propylene (R) | 1.38 | 1.66 | 1.13 | 1.45 | 1.37 | 1.70 | 1.14 | 1.19 | 0.94 |
| $C_2$–$C_4$ olefins & diolefins | 57.36 | 63.60 | 53.42 | 59.47 | 55.11 | 53.46 | 59.71 | 66.27 | 58.44 |

(*) n-hex = n-hexane and n-oct = n-octane

When compared to non-catalytic steam-cracking (column #1, n-hexane as feed), the hybrid catalysts CAT IIIb (columns # 7 and #9) produced more "ethylene+propylene" (11% increase and 7% increase respectively). In terms of the ethylene/propylene (wt) ratio, the hybrid catalysts of this invention showed much lower values, the silicalite-based hybrid catalyst Cc(70)HSil giving the lowest value: 0.94 (column #9 versus 1.38 (non-catalytic steam-cracking, column #1)). Thus, the hybrid catalysts CAT IIIb were very selective in the production of propylene. The same trend was observed with runs carried out with n-octane feed (column #8 versus column #2). It is worth noting that the longer the carbon chain of the feed hydrocarbon, the higher the sum of the yields in ethylene and propylene. This suggests that the hybrid catalysts of this invention are capable of yielding more "ethylene+propylene" than the current steam-cracking technology by more than 15% (columns #7 and #8 of Table 2 versus column #1 of Table 1), wherein petroleum naphtas are used as feeds, and by more than about 10% (column #9).

Since the catalysts of the present invention operate at much lower temperature than the current steam-cracking process, much lower amounts of methane are produced (columns #7 to #9 of Table 2 versus column #1 of Table 1). The lower level of coking also allows an easier regeneration, and less carbon dioxide and other related oxides are emitted during the decoking phase.

Finally, the hybrid catalysts of this invention (CAT IIIb) show a great on-stream stability (for at least 10 hours).

It is to be understood that neither catalyst types of this invention, CAT IIIa and CAT IIIb, promote by themselves Deep Catalytic Cracking (DCC). In fact, the driving force is still the (thermal) steam-cracking. The role of the catalyst is to up-grade the products of thermal cracking, so that greater yields of more commercially valuable hydrocarbons can be obtained while the yield of less valuable methane is significantly decreased. In addition, the catalysts of this invention provide other advantages such as significant energy savings, easier regeneration procedure and less environmentally harmful gases emitted. It appears that the hybrid catalyst configuration (CAT IIIb) is more efficient than the mono-component catalyst configuration.

Although the invention has been described above with respect to one specific form, it will be evident to a person skilled in the art that it may be modified and refined in various ways. It is therefore wished to have it understood that the present invention should not be limited in scope, except by the terms of the following claims.

REFERENCES

[1] R. Le Van Mao, U.S. Pat. No. 4,732,881 (Mar. 22, 1988).

[2] R. Le Van Mao, Microporous and Mesoporous Materials 28 (1999) 9–17.

[3] R. Le Van Mao, "Selective Deep Cracking of Petroleum Naphthas and other Hydrocarbon feedstocks for the Production of Light Olefins and Aromatics", U.S. Patent Application

[4] R. Le Van Mao, S. Melancon, C. Gauthier-Campbell, P. Kletnieks, Catalysis Letters 73 (2/4), (2001), 181.

[5] Chauvel and G. Lefebvre, in Petrochemical Processes, Vol 1, Edition Technip Paris (1989), p 188.

[6] Chauvel and G. Lefebvre, in Petrochemical Processes, Vol 1, Edition Technip Paris (1989), p 130.

The invention claimed is:

1. A hybrid catalyst composition for use in steam-cracking of hydrocarbon feeds to selectively produce light olefins, said catalyst comprising a first component consisting of a catalyst composition consisting essentially of oxides of aluminum, silicon and chromium in a proportion of 3–30 wt. %. 50–95 wt. % and 2–10 wt. %. respectively, and further comprising a second component selected from the group consisting of a crystalline zeolite and a silica molecular sieve, said hybrid catalyst further comprising a binder, and optionally, oxides of monovalent alkaline metals.

2. The hybrid catalyst composition of claim 1 wherein said binder is bentonite clay.

3. The hybrid catalyst composition of claim 2 wherein said bentonite clay is present in a proportion of from 10 wt % to 30 wt % based on the total weight of the hybrid catalyst composition.

4. The hybrid catalyst composition of claim 1 wherein said crystalline zeolite is a pentasil-rype ZSM-5 zeolite.

5. The hybrid catalyst composition of claim 1 wherein said silica molecular sieve is a pentasil-type silicalite.

6. A method of making a hybrid catalyst composition comprising a first component consisting of a catalyst composition comprising oxides of aluminum, silicon and chromium, and further comprising a second component selected from the group consisting of a crystalline zeolite and a silica molecular sieve, said hybrid catalyst further comprising a binder, and optionally, oxides of monovalent alkaline metals, said method comprising the steps of:

(a) impregnating a solution of chromium trioxide on a silica-alumina support;

(b) evaporating the solution-impregnated support to dryness to obtain a first catalytic component;

(c) activating said first catalytic component;

(d) admixing said first catalytic component with a second catalytic component selected from the group consisting of a crystalline zeolite and a silica molecular sieve;

(e) blending said mixture with a binder;

(f) extruding said mixture; and (g) activating said extrudate.

7. The method of claim 6 wherein said binder is bentonite clay.

8. The method of claim 7 wherein said binder is present is a proportion of from 10 wt % to 30 wt % based on the total weight of the resulting catalyst composition.

9. The method of claim 6 wherein said crystalline zeolite is a pentasil-type ZSM-5 zeolite.

10. The method of claim 6 wherein said silica molecular sieve is a pentasil-type silicalite.

11. The method of claim 6 wherein the weight ratio of the second catalytic component to the first catalytic component is 0.2 to 5.0.

* * * * *

UNITED STATES PATENT AND TRADEMARK OFFICE

CERTIFICATE OF CORRECTION

PATENT NO. : 7,098,162 B2
APPLICATION NO. : 10/203230
DATED : August 29, 2006
INVENTOR(S) : Raymond Le Van Mao It is certified that error appears in the above-identified patent and that said Letters Patent is hereby corrected as shown below:

On the face of the issued patent in line 1 of the Abstract, delete “monocomponent and”

Column 12, last line, after “30 wt.%” delete “ . ” (period) and insert -- , -- (comma);
Column 12, last line, after 2-10 wt.% delete “.” (period) and insert -- , -- (comma).

Column 13, line 12, after “pentasil-” delete “rype” and insert -- type --

Signed and Sealed this

Twenty-third Day of January, 2007

JON W. DUDAS
*Director of the United States Patent and Trademark Office*